United States Patent [19]

Weisman

[11] Patent Number: 4,809,454

[45] Date of Patent: Mar. 7, 1989

[54] ADVERTISING SIGN

[76] Inventor: Richard L. Weisman, 22444 Martela Ave., Boca Raton, Fla. 33433

[21] Appl. No.: 132,588

[22] Filed: Dec. 14, 1987

[51] Int. Cl.[4] ..... G09F 7/02

[52] U.S. Cl. ..... 40/611; 40/584

[58] Field of Search ..... 40/10 R, 10 D, 16 R, 40/15 R, 599, 17 R, 611, 584, 597

[56] References Cited

U.S. PATENT DOCUMENTS

| | | | |
|---|---|---|---|
| 2,102,845 | 12/1937 | Howe | 40/599 |
| 2,139,556 | 12/1938 | Meyerson | 40/15 R |
| 2,302,560 | 11/1942 | Latona | 40/15 R |
| 2,559,272 | 10/1941 | Sholkin et al. | 40/611 |
| 4,048,738 | 9/1977 | McHenry | 40/16 |
| 4,149,331 | 4/1979 | Prager | 40/16 |
| 4,282,667 | 8/1981 | Glade | 40/16 |
| 4,715,138 | 12/1987 | Cherico | 40/611 |

*Primary Examiner*—Gene Mancene
*Assistant Examiner*—Michael Lynch
*Attorney, Agent, or Firm*—Joseph Zallen

[57] ABSTRACT

A changeable advertising sign assembly adapted to be mounted on the interior surface of a door. The assembly consists of a frame having a detachable side edge normally inaccessible when the door is closed. A front transparent protective sheet is slidably mounted in the frame in front of a display sheet which is also slidably mounted in the frame.

2 Claims, 2 Drawing Sheets

ADVERTISING SIGN

BACKGROUND OF INVENTION

This invention relates to a changeable sign, and in particular to a changeable advertising sign mounted on a door.

Advertising signs have been previously described which are mounted on common objects as for example, waste receptacles, as shown in U.S. Pat. Nos. 3,793,756 and 3,803,738 and a dasher board for ice skating rinks as shown in U.S. Pat. No. 4,271,622.

One object of this invention is to provide a novel changeable advertising sign suitable for mounting on a door, as, for example, an airplane lavatory door.

Other objects and advantages of this invention will be apparent from the description and claims which follow, taken together with the appended drawings.

SPECIFIC EXAMPLE OF INVENTION

Figure 1:
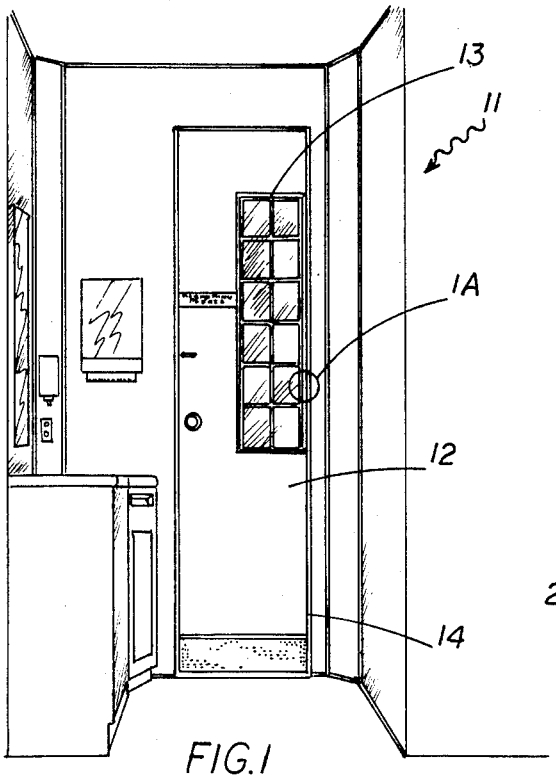
FIG. 1 is a perspective view of the interior of an aircraft lavatory with the door closed showing the advertising sign of this invention mounted on the door of the lavatory.
Figure 1A:
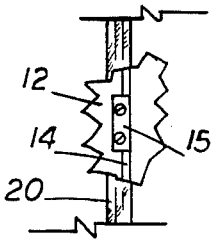
FIG. 1A is an enlarged view with partial cutaway to show the sign close to door frame and covering the hinges.
Figure 2:
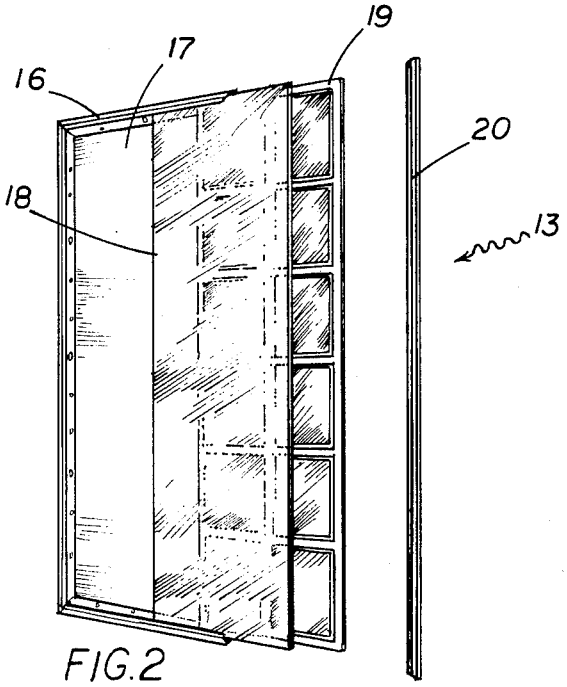
FIG. 2 is a semi-exploded view showing the removable components of the sign.
Figure 3:
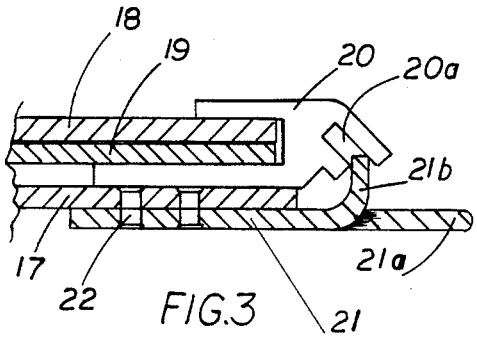
FIG. 3 is a sectional view along line 3—3 of FIG. 5 showing the locking clip in locked position.
Figure 4:
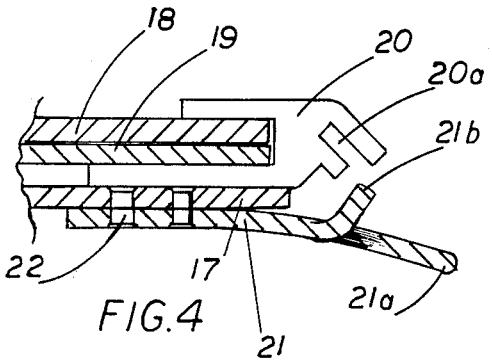
FIG. 4 is a similar view as FIG. 3 showing the locking clip in unlocked position.
Figure 5:
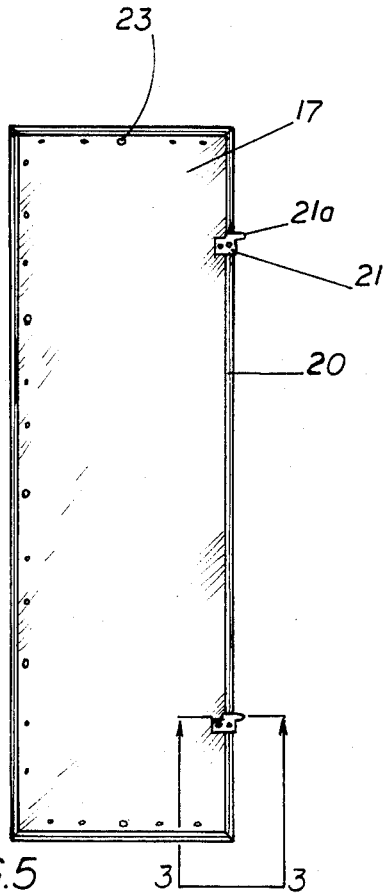
FIG. 5 is a rear view of the sign.

Referring now to the drawings, the airplane lavatory 11 has a door 12 mounted on a door frame 14 by hinges 15. The sign frame 16 is composed of four edges with front extensions which form interior edge slots. The right vertical edge 20 of the frame is detachably removable. The three fixed edges of the sign frame are permanently attached to back plate 17. The advertising sign 13 of this invention is attached to the door 12 in such a manner as to be close to the door frame with the result that there can be no access to the removable edge 20 of the sign frame 16 when the door 12 is in closed position.

When the door is opened it is now possible to remove the vertical frame edge 20 from the remainder of the sign frame so as to gain access to the advertising display sheet 19 and the transparent front protective sheet 18 which are slidably mountable in the slots of frame 16. Vertical frame member 20 is detachably locked on to the back plate 17 of the sign by hooks **21*b* registerable with apertures 20*a* on the vertical member 20. Manipulation of the locking is accomplished by manual pressure on extensions 21*a* of the clips 21. Clips 21 are attached by rivets 22 to back plate 17. Back plate 17 is attached by rivets 23 to the interior side of the door 12**.

Because an airplane door is typically of honeycomb construction it is preferred that the receiving orifices for the rivets be pre-spaced with sockets which can be inserted and adhesively secured at the appropriate locations with materials such as epoxy adhesive. The preferred materials of construction for use in airplanes are those which are lightweight and fire-resistant. Thus, the frame, back plate and clips are preferably made of aluminum, the transparent protective panel of fire-resistant plastic, and the advertising display with a protective non-flammable coating.

I claim:

1. In combination with a door hingedly mounted on a door frame, a novel changeable advertising sign assembly mounted on a surface of the door and comprising:

(a) a back panel mounted on the surface of the door;

(b) a sign frame secured to said back panel and including a detachable side edge positioned so close to an edge of the door frame as to not be detachable when the door is closed;

(c) a front transparent protective sheet slidably mounted in said frame; and (d) a display sheet slidably mounted in said frame behind said transparent sheet and being removably inserted in said frame upon detaching of said side edge.

2. The sign assembly of claim 1 wherein manually operable clip locking means are provided on said back panel for removable attachment of said detachable edge.

* * * * *